US009758850B2

(12) United States Patent
Eguchi et al.

(10) Patent No.: US 9,758,850 B2
(45) Date of Patent: Sep. 12, 2017

(54) HIGH STRENGTH STAINLESS STEEL SEAMLESS PIPE WITH EXCELLENT CORROSION RESISTANCE FOR OIL WELL AND METHOD OF MANUFACTURING THE SAME

(71) Applicant: JFE Steel Corporation, Tokyo (JP)

(72) Inventors: Kenichiro Eguchi, Handa (JP); Yasuhide Ishiguro, Kawasaki (JP); Yukio Miyata, Handa (JP); Mitsuo Kimura, Handa (JP)

(73) Assignee: JFE Steel Corporation (JP)

( * ) Notice: Subject to any disclaimer, the term of this patent is extended or adjusted under 35 U.S.C. 154(b) by 253 days.

(21) Appl. No.: 14/408,772

(22) PCT Filed: Jun. 19, 2013

(86) PCT No.: PCT/JP2013/003807

§ 371 (c)(1),
(2) Date: Dec. 17, 2014

(87) PCT Pub. No.: WO2013/190834

PCT Pub. Date: Dec. 27, 2013

(65) Prior Publication Data

US 2015/0152531 A1 Jun. 4, 2015

(30) Foreign Application Priority Data

Jun. 21, 2012 (JP) ..... 2012-139766
Dec. 20, 2012 (JP) ..... 2012-277718

(51) Int. Cl.

| | |
|---|---|
| ***C22C 38/54*** | (2006.01) |
| ***C21D 9/08*** | (2006.01) |
| ***C22C 38/00*** | (2006.01) |
| ***C22C 38/46*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |

(52) U.S. Cl.

CPC ..... *C22C 38/54* (2013.01); *C21D 6/004* (2013.01); *C21D 6/005* (2013.01); *C21D 6/008* (2013.01); *C21D 9/08* (2013.01); *C21D 9/085* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search

CPC ..... C22C 38/00; C22C 38/001; C22C 38/002; C22C 38/005; C22C 38/008; C22C 38/02; C22C 38/04; C22C 38/06; C22C 38/42; C22C 38/44; C22C 38/46; C22C 38/48; C22C 38/50; C22C 38/54; C21D 6/004; C21D 6/005; C21D 6/008; C21D 9/08; C21D 9/085

See application file for complete search history.

(56) References Cited

U.S. PATENT DOCUMENTS

2006/0243354 A1* 11/2006 Kimura ..... C21D 1/25 148/592
2007/0074793 A1 4/2007 Kimura et al.

FOREIGN PATENT DOCUMENTS

| | | |
|---|---|---|
| EA | 013146 | 2/2010 |
| EP | 1514950 | 3/2005 |
| EP | 1 995 341 | 11/2008 |
| JP | 2-141557 | 5/1990 |
| JP | 2-243740 | 9/1990 |
| JP | 10-1755 | 1/1998 |
| JP | 10-204587 | 8/1998 |
| JP | 2001-026820 | 1/2001 |
| JP | 2001-158945 | 6/2001 |
| JP | 2002-60910 | 2/2002 |
| JP | 2002-129278 | 5/2002 |
| JP | 2005-336595 | 12/2005 |
| JP | 2005-336599 | 12/2005 |
| JP | 2008-81793 | 4/2008 |
| JP | 2011-241477 | 12/2011 |
| JP | 2011-252222 | 12/2011 |
| RU | 2247171 | 2/2005 |

(Continued)

OTHER PUBLICATIONS

Kimura et al., English machine translation of JP 2011-252222, Dec. 2011, p. 1-16.*
Russian Notice of Allowance dated May 20, 2016, of corresponding Russian Application No. 2015101733/02, along with an English translation of the Search Report.
Supplementary European Search Report dated Oct. 9, 2015 of corresponding European Application No. 13807143.6.
Chinese Office Action dated Sep. 26, 2016, of corresponding Chinese Application No. 201380032945.5, along with a Search Report in English.
Japanese Office Action dated Sep. 8, 2015, of corresponding Japanese Application No. 2012-277718, along with a Concise Statement of Relevance of Office Action in English.

(Continued)

*Primary Examiner* — Roy King
*Assistant Examiner* — Caitlin Kiechle
(74) *Attorney, Agent, or Firm* — DLA Piper LLP (US)

(57) ABSTRACT

A pipe having chemical composition contains, by mass %, C: 0.05% or less, Si: 0.5% or less, Mn: 0.15% or more and 1.0% or less, Cr: 13.5% or more and 15.4% or less, Ni: 3.5% or more and 6.0% or less, Mo: 1.5% or more and 5.0% or less, Cu: 3.5% or less, W: 2.5% or less, and N: 0.15% or less so that the relationship $-5.9\times(7.82+27C-0.91\,Si+0.21Mn-0.9Cr+Ni-1.1Mo-0.55W+0.2Cu+11N)\geq 13.0$ is satisfied.

20 Claims, No Drawings

(56) References Cited

FOREIGN PATENT DOCUMENTS

| | | |
|---|---|---|
| RU | 2288967 | 12/2006 |
| WO | 00/79017 | 12/2000 |
| WO | 2010/050519 | 5/2010 |
| WO | 2010/134498 | 11/2010 |

OTHER PUBLICATIONS

Office Action dated Jun. 20, 2017, from corresponding Chinese Application No. 201380032945.5 along with a Concise Statement of Relevance of Office Action in English.

* cited by examiner

HIGH STRENGTH STAINLESS STEEL SEAMLESS PIPE WITH EXCELLENT CORROSION RESISTANCE FOR OIL WELL AND METHOD OF MANUFACTURING THE SAME

TECHNICAL FIELD

This disclosure relates to a seamless steel pipe made of high strength stainless steel (hereinafter, also called high strength stainless steel seamless pipe) which can be ideally used for, for example, an oil well of crude oil or a gas well of natural gas and, in particular, to a high strength stainless steel seamless pipe which can be ideally used for an oil well, having excellent resistance to carbon dioxide corrosion in a very severe corrosive environment in which carbon dioxide ($CO_2$) and chlorine ions ($Cl^-$) are present and the temperature is as high as 200° C., and excellent resistance to sulfide stress cracking in an environment in which hydrogen sulfide ($H_2S$) is present. The term "high strength stainless steel seamless pipe" shall refer to a steel pipe having a yield strength of 110 ksi grade or more and 125 ksi grade or less, that is, a yield strength of 758 MPa or more and 1034 MPa or less.

BACKGROUND ART

Nowadays, oil fields, which are found deep in the ground and have never been considered to date, and oil fields and gas fields in a severe corrosive environment, which is called a "sour" environment in which hydrogen sulfide or the like is present and so forth are being actively developed from the viewpoint of a sharp rise in the price of crude oil and the depletion of petroleum resources which is anticipated in the near future. These oil and gas fields are generally found very deep in the ground and in a severely corrosive environment in which the temperature of the atmosphere is high and $CO_2$, $Cl^-$, and $H_2S$ are present. A steel pipe for an oil well in this kind of environment is required to have not only high strength but also excellent corrosion resistance (resistance to sulfide stress cracking and resistance to carbon dioxide corrosion).

Hitherto, 13% Cr martensitic stainless steel pipes have been widely used as oil country tubular goods to be used for production in an oil and a gas field in an environment in which carbon dioxide $CO_2$, chlorine ions $Cl^-$, and so froth are present. Moreover, nowadays, modified 13Cr martensitic stainless steel, which has a chemical composition containing less C and more Ni and Mo than conventional 13Cr martensitic stainless steel, is increasingly being used.

For example, Japanese Unexamined Patent Application Publication No. 10-1755 discloses modified martensitic stainless steel (pipe) in which the corrosion resistance of 13% Cr martensitic stainless steel (pipe) is improved. The stainless steel (pipe) according to Japanese Unexamined Patent Application Publication No. 10-1755 is martensitic stainless steel with excellent corrosion resistance and resistance to sulfide stress corrosion cracking, the steel having a chemical composition containing 10% to 15% of Cr, in which C content is limited to 0.005% to 0.05%, Ni content is 4.0% or more, Cu content is 0.5% to 3%, and Mo content is 1.0% to 3.0%, while Nieq is adjusted to be −10 or more, and a microstructure including a tempered martensite phase, a martensite phase, and a retained austenite phase, in which the sum of the phase fractions of a tempered martensite phase and a martensite phase is 60% to 90%. It is disclosed that corrosion resistance and resistance to sulfide stress corrosion cracking in a wet carbon dioxide environment and a wet hydrogen sulfide environment are increased using this steel.

In addition, nowadays, oil wells in a corrosive environment at a higher temperature (as high as 200° C.) are being developed. However, there is a problem in that required corrosion resistance, which is satisfactory in this corrosive environment at a high temperature, cannot be stably achieved by the technology according to Japanese Unexamined Patent Application Publication No. 10-1755.

Therefore, a pipe with excellent corrosion resistance and resistance to sulfide stress corrosion cracking for an oil well, which can be used in a corrosive environment at such a high temperature, is required, and various kinds of martensitic stainless steel pipes have been proposed.

For example, Japanese Unexamined Patent Application Publication No. 2005-336595 discloses a high strength stainless steel pipe with excellent corrosion resistance, the steel having a chemical composition containing C: 0.005% to 0.05%, Si: 0.05% to 0.5%, Mn: 0.2% to 1.8%, Cr: 15.5% to 18%, Ni: 1.5% to 5%, Mo: 1% to 3.5%, V: 0.02% to 0.2%, N: 0.01% to 0.15%, and O: 0.006% or less, while a specified relational expression is satisfied by Cr, Ni, Mo, Cu, and C, while a specified relational expression is satisfied by Cr, Mo, Si, C, Mn, Ni, Cu, and N, and a microstructure including a martensite phase as a base phase and 10% to 60%, in terms of volume fraction, of a ferrite phase, or further, 30% or less, in terms of volume fraction, of a retained austenite phase. A stainless steel pipe for an oil well having high strength and toughness, which has satisfactory corrosion resistance even in a severe corrosive environment in which $CO_2$ and $Cl^-$ are present and the temperature is as high as 230° C., can be stably manufactured using that steel.

In addition, Japanese Unexamined Patent Application Publication No. 2008-81793 discloses a high strength stainless steel pipe for an oil well having high toughness and excellent corrosion resistance. The steel pipe according to Japanese Unexamined Patent Application Publication No. 2008-81793 is a steel pipe, the steel pipe having a chemical composition containing, by mass %, C: 0.04% or less, Si: 0.50% or less, Mn: 0.20% to 1.80%, Cr: 15.5% to 17.5%, Ni: 2.5% to 5.5%, V: 0.20% or less, Mo: 1.5% to 3.5%, W: 0.50% to 3.0%, Al: 0.05% or less, N: 0.15% or less, and O: 0.006% or less, while a specified relational expression is satisfied by Cr, Mo, W, and C, while a specified relational expression is satisfied by Cr, Mo, W, Si, C, Mn, Cu, Ni, and N, while a specified relational expression is satisfied by Mo and W, and a microstructure including a martensite phase as a base phase and 10% to 50%, in terms of volume fraction, of a ferrite phase. A high strength stainless steel pipe for an oil well, which has satisfactory corrosion resistance even in a severe corrosive environment at a high temperature in which $CO_2$, $Cl^-$, and $H_2S$ are present, can be stably manufactured using that steel.

In addition, International Publication No. WO 2010/050519 discloses a high strength stainless steel pipe with excellent resistance to sulfide stress cracking and resistance to high temperature carbon dioxide corrosion. The steel pipe according to International Publication No. WO 2010/050519 is a steel pipe, the steel pipe having a chemical composition containing, by mass %, C: 0.05% or less, Si: 1.0% or less, Cr: more than 16% and 18% or less, Mo: more than 2% and 3% or less, Cu: 1% to 3.5%, Ni: 3% or more and less than 5%, Al: 0.001% to 0.1%, Mn: 1% or less, and N: 0.05% or less, while a specified relational expression is satisfied by Mn and N, and a microstructure including a martensite phase as a main phase, 10% to 40%, in terms of volume fraction, of a ferrite phase and 10% or less, in terms of volume fraction, of a retained γ phase. A high strength stainless steel pipe, which has satisfactory corrosion resistance even in a carbon dioxide environment at a temperature of as high as 200° C., and which has satisfactory resistance to sulfide stress cracking even in an atmosphere gas at a lowered temperature, can be manufactured using that steel.

In addition, International Publication No. WO 2010/134498 discloses a stainless steel for an oil well, the steel having a chemical composition containing, by mass %, C: 0.05% or less, Si: 0.5% or less, Mn: 0.01% to 0.5%, P: 0.04% or less, S: 0.01% or less, Cr: more than 16.0% to 18.0%, Ni: more than 4.0% to 5.6%, Mo: 1.6% to 4.0%, Cu: 1.5% to 3.0%, Al: 0.001% to 0.10%, and N: 0.050% or less, while a specified relational expression is satisfied by Cr, Cu, Ni, and Mo, while a specified relational expression is satisfied by (C+N), Mn, Ni, Cu, and (Cr+Mo), a microstructure including a martensite phase and 10% to 40%, in terms of volume fraction, of a ferrite phase, while the ferrite phase has a length of 50 μm in the thickness direction from the surface of the steel and intersects at a ratio of more than 85% with virtual line segments placed in a line at intervals of 10 μm in a range of 200 μm, and a yield strength of 758 MPa or more. A stainless steel for an oil well, which has excellent corrosion resistance in an environment at a high temperature, and which has excellent resistance to SSC at room temperature, can be manufactured using that steel.

In the methods according to Japanese Unexamined Patent Application Publication No. 10-1755, Japanese Unexamined Patent Application Publication No. 2005-336595, Japanese Unexamined Patent Application Publication No. 2008-81793, International Publication No. WO 2010/050519 and International Publication No. WO 2010/134498, corrosion resistance is improved by setting Cr content to be more than 15 mass %. However, there is a problem in that an increase in the content of Cr, which is an expensive alloy element, causes a sharp rise in cost, which results in economic disadvantage.

It could therefore be helpful to provide a high strength stainless steel seamless pipe for an oil well, the pipe having excellent corrosion resistance (resistance to carbon dioxide corrosion) in a severe corrosive environment in which $CO_2$ and $Cl^-$ are present and the temperature is as high as 200° C. and excellent corrosion resistance (resistance to sulfide stress cracking) in an environment in which $H_2S$ is present without an increase in Cr content and with a chemical composition having a comparatively low Cr content of about 15 mass % and a method for manufacturing the pipe. "High strength" shall refer to the case where the yield strength of the steel is 110 ksi (758 MPa) or more.

SUMMARY

We thus provide:

(1) A high strength stainless steel seamless pipe with excellent corrosion resistance for an oil well, the pipe having a chemical composition containing, by mass %, C: 0.05% or less, Si: 0.5% or less, Mn: 0.15% or more and 1.0% or less, P: 0.030% or less, S: 0.005% or less, Cr: 13.5% or more and 15.4% or less, Ni: 3.5% or more and 6.0% or less, Mo: 1.5% or more and 5.0% or less, Cu: 3.5% or less, W: 2.5% or less, N: 0.15% or less, and the balance being Fe and inevitable impurities so that formula (1) below is satisfied by C, Si, Mn, Cr, Ni, Mo, W, Cu, and N:

$$-5.9\times(7.82+27C-0.91Si+0.21Mn-0.9Cr+Ni-1.1Mo-0.55W+0.2Cu+11N)\geq 13.0 \quad (1),$$

(where C, Si, Mn, Cr, Ni, Mo, W, Cu, and N respectively denote the contents (mass %) of corresponding chemical elements).

(2) The high strength stainless steel seamless pipe with excellent corrosion resistance for an oil well according to item (1), in which the pipe has a chemical composition further containing, by mass %, V: 0.02% or more and 0.12% or less.

(3) The high strength stainless steel seamless pipe with excellent corrosion resistance for an oil well according to item (1) or (2), in which the pipe has a chemical composition further containing, by mass %, Al: 0.10% or less.

(4) The high strength stainless steel seamless pipe with excellent corrosion resistance for an oil well according to any one of items (1) to (3), in which the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

(5) The high strength stainless steel seamless pipe with excellent corrosion resistance for an oil well according to any one of items (1) to (4), in which the pipe has a chemical composition further containing, by mass %, one or more selected from among REM: 0.005% or less, Ca: 0.005% or less, and Sn: 0.20% or less.

(6) The high strength stainless steel seamless pipe with excellent corrosion resistance for an oil well according to any one of items (1) to (5), in which the pipe further has a microstructure including a martensite as a base phase and 10% or more and 60% or less, in terms of volume fraction, of a ferrite phase as a second phase.

(7) The high strength stainless steel seamless pipe with excellent corrosion resistance for an oil well according to item (6), in which the pipe has a microstructure further including, in terms of volume fraction, 30% or less of a retained austenite phase.

(8) A method of manufacturing a high strength stainless steel seamless pipe with excellent corrosion resistance for an oil well, the method including performing a quenching treatment and a tempering treatment on a stainless steel seamless pipe having a chemical composition containing, by mass %, C: 0.05% or less, Si: 0.5% or less, Mn: 0.15% or more and 1.0% or less, P: 0.030% or less, S: 0.005% or less, Cr: 13.5% or more and 15.4% or less, Ni: 3.5% or more and 6.0% or less, Mo: 1.5% or more and 5.0% or less, Cu: 3.5% or less, W: 2.5% or less, N: 0.15% or less, and the balance being Fe and inevitable impurities so that formula (1) below is satisfied by C, Si, Mn, Cr, Ni, Mo, W, Cu, and N:

$$-5.9\times(7.82+27C-0.91Si+0.21Mn-0.9Cr+Ni-1.1Mo-0.55W+0.2Cu+11N)\geq 13.0 \quad (1),$$

(where C, Si, Mn, Cr, Ni, Mo, W, Cu, and N respectively denote the contents (mass %) of corresponding chemical elements), the quenching treatment including heating the pipe up to a temperature of 850° C. or higher and cooling the heated pipe at a cooling rate equal to or more than that of air cooling to a temperature of 50° C. or lower, the tempering treatment including heating the treated pipe up to a temperature equal to or lower than the $A_{c1}$ transformation point and cooling the heated pipe.

(9) The method of manufacturing a high strength stainless steel seamless pipe with excellent corrosion resistance for an oil well according to item (8), in which the pipe has a chemical composition further containing, by mass %, V: 0.02% or more and 0.12% or less.

(10) The method of manufacturing a high strength stainless steel seamless pipe with excellent corrosion resistance for an oil well according to item (8) or (9), in which the pipe has a chemical composition further containing, by mass %, Al: 0.10% or less.

(11) The method of manufacturing a high strength stainless steel seamless pipe with excellent corrosion resistance for an oil well according to any one of items (8) to (10), in which the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

(12) The method of manufacturing a high strength stainless steel seamless pipe with excellent corrosion resistance for an oil well according to any one of items (8) to (11), in which the pipe has a chemical composition further containing, by mass %, one or more selected from among REM: 0.005% or less, Ca: 0.005% or less, and Sn: 0.20% or less.

It is possible to manufacture, at comparatively low cost, a high strength stainless steel seamless pipe having excellent resistance to carbon dioxide corrosion in a corrosive environment in which $CO_2$ and $Cl^-$ are present and the temperature is as high as 200° C. and excellent resistance to sulfide stress cracking equivalent to that of a steel having a chemical composition containing about 17 mass % of Cr in an environment in which $H_2S$ is present even with a chemical composition having comparatively low Cr content of about 15 mass %, which is significantly effective in industry.

DETAILED DESCRIPTION

We conducted investigations in the case of a stainless pipe having a chemical composition having a comparatively low Cr content of about 15 mass %, regarding various factors having influences on corrosion resistance in a corrosive environment in which $CO_2$ and $Cl^-$ are present and the temperature is as high as 200° C. and corrosion resistance in an environment in which $H_2S$ is present and, as a result, found that excellent resistance to carbon dioxide corrosion can be achieved even in an environment in which $CO_2$ and $Cl^-$ are present and the temperature is as high as 200° C. and that resistance to sulfide stress corrosion cracking equivalent to that of 17Cr steel can be achieved even in a corrosive environment in which $H_2S$ is present, by controlling a microstructure to be a compound microstructure including a martensite phase as a main phase and 10% to 60%, in terms of volume fraction, of a ferrite phase as a second phase, or further, 30% or less, in terms of volume fraction, of a retained austenite phase.

Then, we found that to control the microstructure having a comparatively low Cr content of about 15 mass % to be the specified compound microstructure, it is important to control the contents of C, Si, Mn, Cr, Ni, Mo, W, Cu, and N so that formula (1) below is satisfied:

$$-5.9\times(7.82+27C-0.91Si+0.21Mn-0.9Cr+Ni-1.1Mo-0.55W+0.2Cu+11N)\geq 13.0 \quad (1),$$

(where C, Si, Mn, Cr, Ni, Mo, W, Cu, and N respectively denote the contents (mass %) of corresponding chemical elements). The left-hand side of formula (1) was experimentally derived as an indicator of a tendency for a ferrite phase to be formed and we found that it is important in achieving the required compound microstructure to control the contents and kinds of the alloy elements so that formula (1) is satisfied.

We believe that the reason why resistance to sulfide stress cracking equivalent to that of steel containing 17% of Cr can be achieved by forming a compound microstructure including at least a ferrite phase in addition to a martensite phase is as follows.

Since a ferrite phase is a phase which has good pitting resistance (pitting corrosion resistance) and is stable in a temperature range from high to low, a ferrite phase is precipitated in a form of a layer in the rolling direction, that is, in the axis direction of a pipe. Therefore, it is presumed that, since the layered microstructure is parallel to the direction of loaded stress in a sulfide stress cracking test, which means the direction of loaded stress is at a right angle to the direction in which a crack (SSC) easily propagates when a sulfide stress cracking (SSC) test is performed, the propagation of a crack (SSC) is suppressed, which results in an improvement in corrosion resistance (resistance to SSC).

The high strength stainless steel seamless pipe for an oil well has a chemical composition containing, by mass %, C: 0.05% or less, Si: 0.5% or less, Mn: 0.15% or more and 1.0% or less, P: 0.030% or less, S: 0.005% or less, Cr: 13.5% or more and 15.4% or less, Ni: 3.5% or more and 6.0% or less, Mo: 1.5% or more and 5.0% or less, Cu: 3.5% or less, W: 2.5% or less, N: 0.15% or less, and the balance being Fe and inevitable impurities so that formula (1) below is satisfied by C, Si, Mn, Cr, Ni, Mo, W, Cu, and N:

$$-5.9\times(7.82+27C-0.91Si+0.21Mn-0.9Cr+Ni-1.1Mo-0.55W+0.2Cu+11N)\geq 13.0 \quad (1),$$

(where C, Si, Mn, Cr, Ni, Mo, W, Cu, and N respectively denote the contents (mass %) of corresponding chemical elements).

First, the reason for the limitations on the chemical composition of the pipe will be described. Hereinafter, mass % shall be denoted simply by %, unless otherwise noted. C: 0.05% or less Although C is an important chemical element which increases the strength of martensitic stainless steel and it is preferable that C content be 0.01% or more to achieve the required strength, there is a deterioration in resistance to sulfide stress cracking when the C content is more than 0.05%. Therefore, the C content is limited to 0.05% or less, preferably 0.02% or more and 0.04% or less.

Si: 0.5% or Less

Si is a chemical element effective as a deoxidizing agent, and it is preferable that Si content be 0.1% or more to realize this effect. On the other hand, there is a deterioration in hot workability when the Si content is more than 0.5%. Therefore, the Si content is limited to 0.5% or less, preferably 0.2% or more and 0.3% or less.

Mn: 0.15% or More and 1.0% or Less

Mn is a chemical element which increases the strength of steel, and it is necessary that Mn content be 0.15% or more to achieve the required strength. On the other hand, there is a deterioration in toughness when the Mn content is more than 1.0%. Therefore, the Mn content is limited to 0.15% or more and 1.0% or less, preferably 0.2% or more and 0.5% or less.

P: 0.030% or Less

Although, since P deteriorates corrosion resistance such as resistance to carbon dioxide corrosion, pitting corrosion resistance, and resistance to sulfide stress cracking, it is preferable that P content be as small as possible, it is acceptable if the P content is 0.030% or less. Therefore, the P content is limited to 0.030% or less, preferably 0.020% or less.

S: 0.005% or Less

Although, since S is a chemical element having a negative effect on stable operation of a pipe manufacturing process as a result of decreasing hot workability, it is preferable that S content be as small as possible, pipe manufacturing through use of a normal process is possible when the S content is 0.005% or less. Therefore, the S content is limited to 0.005% or less, preferably 0.002% or less.

Cr: 13.5% or More and 15.4% or Less

Cr is a chemical element which contributes to an improvement in corrosion resistance as a result of forming a protective film, and it is necessary that Cr content be 13.5% or more. On the other hand, the required strength cannot be achieved due to an increase in the phase fraction of a ferrite phase when the Cr content is more than 15.4%. Therefore, the Cr content is limited to 13.5% or more and 15.4% or less, preferably 14.0% or more and 15.0% or less.

Ni: 3.5% or More and 6.0% or Less

Ni is a chemical element which improves corrosion resistance as a result of strengthening a protective film. In addition, Ni increases the strength of steel through solid solution strengthening. These effects become noticeable when Ni content is 3.5% or more. On the other hand, there is a decrease in strength due to a deterioration in the stability of a martensite phase when the Ni content is more than 6.0%. Therefore, the Ni content is limited to 3.5% or more and 6.0% or less, preferably 3.5% or more and 5.0% or less.

Mo: 1.5% or More and 5.0% or Less

Mo is a chemical element which improves resistance to pitting corrosion caused by $Cl^-$ and low pH, and it is necessary that Mo content be 1.5% or more. It cannot be said that sufficient corrosion resistance can be achieved in a severe corrosive environment when the Mo content is less than 1.5%. On the other hand, when the Mo is contained in a large amount of more than 5.0%, there is a sharp rise in manufacturing cost because Mo is an expensive chemical element, and there is a deterioration in toughness and corrosion resistance due to the precipitation of a $\chi$ phase. Therefore, the Mo content is limited to 1.5% or more and 5.0% or less, preferably 3.0% or more and 5.0% or less.

Cu: 3.5% or Less

Cu is a chemical element which improves resistance to sulfide stress cracking by suppressing hydrogen penetration into steel as a result of strengthening a protective film. It is preferable that Cu content be 0.3% or more to realize this effect. On the other hand, there is a deterioration in hot workability as a result of causing the intergranular precipitation of CuS when the Cu content is more than 3.5%. Therefore, the Cu content is limited to 3.5% or less, preferably 0.5% or more and 2.0% or less.

W: 2.5% or Less

W contributes to an increase in the strength of steel and improves resistance to sulfide stress cracking. It is preferable that W content be 0.5% or more to realize these effects. On the other hand, there is a deterioration in toughness and corrosion resistance due to the precipitation of a $\chi$ phase when the W is contained in a large amount of more than 2.5%. Therefore, the W content is limited to 2.5% or less, preferably 0.8% or more and 1.2% or less.

N: 0.15% or Less

N is a chemical element which significantly improves pitting resistance. This effect becomes noticeable when N content is 0.01% or more. On the other hand, various kinds of nitrides are formed when the N content is more than 0.15%, which results in a deterioration in toughness. Therefore, the N content is limited to 0.15% or less, preferably 0.01% or more and 0.07% or less.

The pipe has a chemical composition containing the chemical elements described above in amounts in the ranges described above, while formula (1) is satisfied by C, Si, Mn, Cr, Ni, Mo, W, Cu, and N.

$$-5.9\times(7.82+27C-0.91Si+0.21Mn-0.9Cr+Ni-1.1Mo-0.55W+0.2Cu+11N)\geq 13.0 \quad (1)$$

The left-hand side of formula (1) was derived as an indicator of a tendency for a ferrite phase to be formed, and the dual phase microstructure of martensite and ferrite phases can be stably achieved as the microstructure of a product when the contents of the alloy elements represented in formula (1) are controlled so that formula (1) is satisfied. Therefore, the contents of the alloy elements are controlled so that formula (1) is satisfied.

The chemical composition described above is the basic chemical composition and, in addition to the basic chemical composition, the chemical composition may further contain V: 0.02% or more and 0.12% or less and/or Al: 0.10% or less and/or one or more selected from among Nb: 0.02% or more and 0.50% or less, Ti: 0.02% or more and 0.16% or less, Zr: 0.50% or less, and B: 0.0030% or less and/or one or more selected from among REM: 0.005% or less, Ca: 0.005% or less, and Sn: 0.20% or less as selective chemical elements, as needed.

V: 0.02% or More and 0.12% or Less

V is a chemical element which increases the strength of steel through precipitation strengthening and resistance to sulfide stress cracking and may be contained as needed. It is preferable that V content be 0.02% or more to realize these effects. On the other hand, there is a deterioration in toughness in the case where the V content is more than 0.12%. Therefore, it is preferable that the V content be limited to 0.02% or more and 0.12% or less, more preferably 0.04% or more and 0.08% or less.

Al: 0.10% or Less

Al is a chemical element effective as a deoxidization agent and may be contained as needed. It is preferable that Al content be 0.01% or more to realize this effect. On the other hand, there is a negative effect on toughness due to the amount of oxides being excessive when Al is contained in a large amount of more than 0.10%. Therefore, it is preferable that the Al content be 0.10% or less, more preferably 0.02% or more and 0.06% or less.

One or more selected from among Nb: 0.02% or more and 0.50% or less, Ti: 0.02% or more and 0.16% or less, Zr: 0.50% or less, and B: 0.0030% or less Nb, Ti, Zr, and B are all chemical elements which contribute to an increase in strength and may be contained as needed.

Nb contributes not only to an increase in strength as described above but also to an improvement in toughness. It is preferable that Nb content be 0.02% or more to realize these effects. On the other hand, there is a deterioration in toughness when the Nb content is more than 0.50%. Therefore, when Nb is contained, the Nb content is set to be 0.02% or more and 0.50% or less.

Ti contributes not only to an increase in strength as described above but also to an improvement in resistance to sulfide stress cracking. It is preferable that Ti content be 0.02% or more to realize these effects. On the other hand, there is a deterioration in toughness and resistance to sulfide stress cracking due to formation of precipitates of a large size when the Ti content is more than 0.16%. Therefore, when Ti is contained, it is preferable that the Ti content be limited to 0.02% or more and 0.16% or less.

Zr contributes not only to an increase in strength as described above but also to an improvement in resistance to sulfide stress cracking. It is preferable that Zr content be 0.02% or more to realize these effects. On the other hand, there is a deterioration in toughness when the Zr content is more than 0.50%. Therefore, in the case where Zr is contained, it is preferable that the Zr content be limited to 0.50% or less.

B contributes not only to an increase in strength as described above but also to an improvement in resistance to sulfide stress cracking and hot workability. It is preferable that B content be 0.0005% or more to realize these effects. On the other hand, there is a deterioration in toughness and hot workability when the B content is more than 0.0030%. Therefore, it is preferable that the B content be limited to 0.0005% or more and 0.0030% or less.

One or more selected from among REM: 0.005% or less, Ca: 0.005% or less, and Sn: 0.20% or less REM, Ca, and Sn are all chemical elements which contribute to an improvement in resistance to sulfide stress cracking, and one or more selected from among these may be contained as needed. It is preferable that REM content be 0.001% or more, Ca content be 0.001% or more, and Sn content be 0.05% or more to realize these effects. On the other hand, there is an economic disadvantage when the REM content is more than 0.005%, the Ca content is more than 0.005%, and the Sn content is more than 0.20% because effects corresponding to the contents cannot be expected due to the saturation of the effects. Therefore, when REM, Ca, and Sn are contained, it is preferable that the REM content be limited to 0.005% or less, the Ca content be limited to 0.005% or less, and the Sn content be limited to 0.20% or less.

The remainder of the chemical composition other than chemical elements described above consists of Fe and inevitable impurities.

Second, the reason for limitations on the microstructure of the high strength stainless steel seamless pipe for an oil well will be described.

The high strength stainless steel seamless pipe for an oil well has a chemical composition described above and a microstructure including a martensite phase as a base phase and 10% or more and 60% or less, in terms of volume fraction, of a ferrite phase as a second phase, or further, 30% or less, in terms of volume fraction, of a retained austenite phase.

The base phase of the seamless pipe is a martensite phase to achieve a required high strength. In addition, the microstructure of the seamless pipe is a dual (compound) phase microstructure of martensite and ferrite phases at least by precipitating 10% or more and 60% or less, in terms of volume fraction, of a ferrite phase as a second phase to achieve resistance to sulfide stress cracking equivalent to that of steel containing 17% of Cr. Since a layered microstructure is formed in the axis direction of a pipe by this method, propagation of cracks is suppressed, which results in an improvement in resistance to sulfide stress cracking. The required corrosion resistance cannot be achieved when the phase fraction of a ferrite phase is less than 10% because the layered microstructure is not formed. On the other hand, the required strength cannot be achieved when a ferrite phase is precipitated in a large amount of more than 60%. Therefore, the volume fraction of a ferrite phase as a second phase is set to be 10% or more and 60% or less, preferably 20% or more and 50% or less.

In addition to a ferrite phase as a second phase, a retained austenite phase may be precipitated in an amount of 30% or less in terms of volume fraction. There is an improvement in toughness and ductility due to the presence of a retained austenite phase. These effects can be achieved when the volume fraction of a retained austenite phase is 30% or less. The required strength cannot be achieved when there is a retained austenite phase in a large amount of more than 30% in terms of volume fraction. Therefore, it is preferable that the volume fraction of a retained austenite phase as a second phase be 30% or less.

Third, a preferable method of manufacturing the high strength stainless steel seamless pipe for an oil well will be described.

A stainless steel seamless pipe having the chemical composition described above is a starting material. There is no particular limitation on a method of manufacturing the stainless steel seamless pipe as a starting material, and any of commonly well-known manufacturing methods may be applied.

For example, it is preferable that molten steel having the chemical composition described above be refined by a common refining method such as one using a converter furnace and that a material for a pipe such as a billet be made by a common method such as a continuous casting method or an ingot-casting and slabbing-rolling method. Subsequently, this material for a pipe is heated and subjected to pipe-rolling using a commonly well-known pipe-rolling process such as a Mannesmann plug mill process or a Mannesmann mandrel mill process and made into a seamless pipe having a required size and the chemical composition described above.

It is preferable that the seamless pipe be cooled to room temperature at a cooling rate equal to or more than that of air cooling (about more than 0.3° C./sec.) after pipe-rolling has been performed. A microstructure having a martensite phase as a base phase can be achieved by this method. Note that, a seamless pipe may be made by a hot extrusion method of a pressing method.

Following the cooling process in which the seamless pipe is cooled to room temperature at a cooling rate equal to or more than that of air cooling, a quenching treatment, in which the pipe is further heated up to a temperature of 850° C. or higher and then cooled to a temperature of 50° C. or lower at a cooling rate equal to or more than that of air cooling (about more than 0.3° C./sec.), is performed. A seamless pipe having a martensite phase as a base phase and an appropriate amount of a ferrite phase is made by this method. The required strength cannot be achieved when the heating temperature is lower than 850° C. Note that, it is preferable that the heating temperature for a quenching treatment be 960° C. to 1100° C.

The seamless pipe subjected to a quenching treatment is subjected to a tempering treatment in which the pipe is heated up to a temperature equal to or lower than the $A_{c1}$ transformation temperature and then cooled with air.

The microstructure of the pipe becomes a microstructure including a tempered martensite phase, a ferrite phase, and a small amount of a retained austenite phase (retained γ phase) by performing a tempering treatment in which the pipe is heated up to a temperature equal to or lower than the $A_{c1}$ transformation temperature, preferably 700° C. or lower and 520° C. or higher. A seamless pipe having the required high strength, high toughness and excellent resistance to sulfide stress cracking is made by this method. The required high strength, high toughness, and excellent resistance to sulfide stress cracking cannot be achieved when the tempering temperature is higher than the $A_{c1}$ transformation temperature because a as-quenched martensite phase is formed. Note that, the tempering treatment described above may be performed without performing a quenching treatment.

Our pipes and methods will be further described on the basis of the examples hereafter.

EXAMPLES

Molten steel having a chemical composition given in Table 1 was refined using a converter furnace and cast into a billet (steel material for pipes) using a continuous casting method. The billet was subjected to pipe-rolling using a model seamless pipe rolling mill, cooled with air after pipe-rolling had been performed and made into a seamless pipe having an outer diameter of 83.8 mm and a wall thickness of 12.7 mm.

A test piece material was cut out of the obtained seamless pipe and subjected to a quenching treatment in which the material was heated and cooled under the conditions given in Table 2. Subsequently, the test piece material was further subjected to a tempering treatment in which the material was heated and cooled with air under the conditions given in Table 2.

The photograph of the microstructure of a test piece to be used for observation of microstructure, which was cut out of the test piece material which had been subjected to a quenching-tempering treatment and etched with a Vilella reagent, was taken using a scanning electron microscope (at a magnification of 1000 times) and the phase fraction (volume %) of a ferrite phase was calculated using an image analysis apparatus.

In addition, the phase fraction of a retained austenite phase was observed using X-ray diffractometry. The integrated intensities of diffracted X-rays of the (220) plane of a γ phase and the (211) plane of an a phase of a test piece to be used for measurement, which was cut out of the test piece material which had been subjected to a quenching-tempering treatment, were measured using X-ray diffraction and the volume fraction of a γ phase was derived through conversion using the following equation:

$$\gamma(\text{volume fraction})=100/(1+(I\alpha R\gamma/I\gamma R\alpha)),$$

where Iα: integrated intensity of a α phase

Rα: theoretically calculated value of a on the basis of crystallography

Iγ: integrated intensity of a γ phase

Rγ: theoretically calculated value of γ on the basis of crystallography. In addition, the volume fraction of a martensite phase was derived as the remainder other than these phases.

In addition, a tensile test was carried out in accordance with the API standards using an strip tensile test piece specified in the API standards, which was cut out of the test piece material which had been subjected to a quenching-tempering treatment, and tensile properties (yield strength YS and tensile strength TS) were obtained.

In addition, a Charpy impact test was carried out in accordance with JIS Z 2242 using a test piece having a V notch (10 mm in thickness), which was cut out of the test piece material which had been subjected to a quenching-tempering treatment, and an absorbed energy $_vE_{-10}$ (J) at a temperature of −10° C. was obtained, through which toughness was evaluated.

In addition, a corrosion test was carried out using a corrosion test piece having a thickness of 3 mm, a width of 30 mm, and a length of 40 mm, which was made, by performing machining, of the test piece material which had been subjected to a quenching-tempering treatment.

The corrosion test was carried out under conditions in which the test piece was immersed in a testing solution, which was an aqueous solution containing 20% of NaCl (solution temperature was 200° C., in a $CO_2$ atmosphere under a pressure of 30 atmospheres) held in an autoclave, for a duration of 14 days. The weight of the test piece was measured after the test had been carried out, and a corrosion rate was calculated from a decrease in weight between before and after the corrosion test. In addition, the surface of the test piece was observed using a loupe at a magnification of 10 times after the corrosion test had been carried out in order to find out whether or not pitting corrosion occurred. When the diameter of pits was 0.2 mm or more this is referred to pitting corrosion has occurred.

Moreover, a SSC resistance test was carried out in accordance with NACE TM0177 Method A using a test piece having a round bar shape (6.4 mmϕ in diameter), which was made, by performing machining, of the test piece material which had been subjected to a quenching-tempering treatment.

The SSC resistance test was carried out under conditions in which the test piece was immersed in a testing solution, in which an aqueous solution containing 20% of NaCl (solution temperature was 25° C., in an atmosphere containing 0.1 atmospheres of $H_2S$ and 0.9 atmospheres of $CO_2$) was mixed with acetic acid and sodium acetate so that the pH value of the testing solution was 3.5, for a duration of 720 hours with a loading stress being 90% of a yield stress. The test piece was observed after the test had been carried out to find out whether or not a crack occurred.

The obtained results are given in Table 2.

TABLE 1

| Steel | Chemical Composition (mass %) | | | | | | | | | | | | |
|---|---|---|---|---|---|---|---|---|---|---|---|---|---|
| Code | C | Si | Mn | P | S | Cr | Ni | Mo | Cu | V | W | N | Al |
| A | 0.03 | 0.28 | 0.31 | 0.018 | 0.0007 | 14.4 | 3.83 | 4.56 | 1.01 | 0.056 | 0.91 | 0.0556 | 0.035 |
| B | 0.01 | 0.22 | 0.30 | 0.019 | 0.0007 | 15.1 | 5.20 | 2.46 | 1.99 | 0.057 | 0.99 | 0.0092 | 0.021 |
| C | 0.03 | 0.28 | 0.31 | 0.019 | 0.0007 | 14.8 | 3.96 | 4.47 | 1.01 | 0.054 | 0.88 | 0.0535 | 0.036 |
| D | 0.03 | 0.28 | 0.31 | 0.017 | 0.0007 | 14.1 | 3.93 | 4.54 | 1.01 | 0.055 | 0.93 | 0.0534 | 0.036 |
| E | 0.03 | 0.29 | 0.31 | 0.018 | 0.0007 | 14.4 | 3.83 | 4.49 | 1.03 | 0.057 | 0.88 | 0.0548 | 0.034 |
| F | 0.03 | 0.28 | 0.31 | 0.018 | 0.0007 | 14.1 | 4.00 | 4.56 | 1.02 | 0.057 | 0.89 | 0.0563 | 0.035 |
| G | 0.03 | 0.29 | 0.32 | 0.018 | 0.0007 | 14.0 | 3.72 | 4.43 | 1.00 | 0.056 | 0.92 | 0.0573 | 0.035 |
| H | 0.01 | 0.36 | 0.44 | 0.009 | 0.0008 | 12.6 | 6.45 | 2.42 | 0.03 | — | — | 0.0085 | 0.021 |
| I | 0.01 | 0.22 | 0.29 | 0.019 | 0.0007 | 14.4 | 5.01 | 2.55 | 2.01 | 0.060 | 0.97 | 0.0096 | — |
| J | 0.01 | 0.23 | 0.31 | 0.018 | 0.0007 | 14.7 | 5.22 | 2.46 | 1.97 | — | 0.94 | 0.0098 | — |
| K | 0.01 | 0.23 | 0.30 | 0.019 | 0.0007 | 14.5 | 4.99 | 2.44 | 1.92 | — | 1.03 | 0.0089 | 0.021 |

TABLE 1-continued

| | | | | | | | | | | | | | |
|---|---|---|---|---|---|---|---|---|---|---|---|---|---|
| L | 0.03 | 0.29 | 0.31 | 0.018 | 0.0007 | 15.4 | 3.99 | 4.60 | 0.98 | — | 0.92 | 0.0526 | 0.036 |
| M | 0.03 | 0.29 | 0.31 | 0.018 | 0.0007 | 14.1 | 3.68 | 4.32 | 1.02 | — | 0.85 | 0.0541 | 0.034 |

| Steel Code | Chemical Composition (mass %) Nb, Ti, Zr, B, | REM, Ca, Sn | Value of Left-hand Side of Formula (1)* | Judgment of Conformity to Formula (1) | Note |
|---|---|---|---|---|---|
| A | Nb: 0.091 | — | 31.8 | ○ | Example |
| B | — | — | 18.8 | ○ | Example |
| C | Nb: 0.093, Ti: 0.090 | — | 32.6 | ○ | Example |
| D | Nb: 0.094, B: 0.0012 | — | 29.7 | ○ | Example |
| E | Nb: 0.092 | REM: 0.001 | 31.3 | ○ | Example |
| F | Nb: 0.094 | Ca: 0.0020 | 29.1 | ○ | Example |
| G | Nb: 0.093 | Sn: 0.10 | 29.5 | ○ | Example |
| H | Ti: 0.097 | — | −2.4 | x | Comparative Example |
| I | — | — | 16.7 | ○ | Example |
| J | — | — | 16.6 | ○ | Example |
| K | — | — | 16.9 | ○ | Example |
| L | Nb: 0.095, Ti: 0.094, Zr: 0.05, B: 0.0012 | — | 36.9 | ○ | Example |
| M | — | REM: 0.001, Ca: 0.0021, Sn: 0.10 | 29.0 | ○ | Example |

*$-5.9 \times (7.82 + 27C - 0.91Si + 0.21Mn - 0.9Cr + Ni - 1.1Mo - 0.55W + 0.2Cu + 11N) \geq 13.0$ (1)

TABLE 2

| | | Quenching Treatment | | | | Tempering Treatment | | Microstructure | | |
|---|---|---|---|---|---|---|---|---|---|---|
| Pipe No. | Steel Code | Heating Temperature (° C.) | Holding time (min) | Cooling Rate for Quenching* (° C./sec.) | Cooling Stop Temperature (° C.) | Heating Temperature (° C.) | Holding Time (min) | Class** | F Phase Fraction (%) | Retained γ Phase fraction (%) |
| 1 | A | 1030 | 20 | 0.5 | 25 | 600 | 30 | M + F + γ | 30 | 15 |
| 2 | A | 840 | 20 | 0.5 | 25 | 600 | 30 | M + F + γ | 25 | 15 |
| 3 | A | 1030 | 20 | 0.5 | 65 | 600 | 30 | M + F + γ | 30 | 20 |
| 4 | A | 1030 | 20 | 0.5 | 25 | 675 | 30 | M + F + γ | 30 | 30 |
| 5 | B | 960 | 15 | 25 | 25 | 615 | 30 | M + F + γ | 20 | 5 |
| 6 | C | 1030 | 20 | 0.5 | 25 | 600 | 30 | M + F + γ | 30 | 15 |
| 7 | D | 1030 | 20 | 0.5 | 25 | 600 | 30 | M + F + γ | 30 | 15 |
| 8 | E | 1030 | 20 | 0.5 | 25 | 600 | 30 | M + F + γ | 30 | 15 |
| 9 | F | 1030 | 20 | 0.5 | 25 | 600 | 30 | M + F + γ | 30 | 15 |
| 10 | G | 1030 | 20 | 0.5 | 25 | 600 | 30 | M + F + γ | 30 | 15 |
| 11 | H | 920 | 15 | 26 | 25 | 525 | 30 | M + γ | — | 15 |
| 12 | I | 960 | 15 | 25 | 25 | 615 | 30 | M + F + γ | 20 | 5 |
| 13 | J | 960 | 15 | 25 | 25 | 615 | 30 | M + F + γ | 15 | 5 |
| 14 | K | 960 | 15 | 25 | 25 | 615 | 30 | M + F + γ | 20 | 5 |
| 15 | L | 1030 | 20 | 0.5 | 25 | 600 | 30 | M + F + γ | 30 | 15 |

TABLE 2-continued

| | | | | | | | | | | |
|---|---|---|---|---|---|---|---|---|---|---|
| 16 | M | 1030 | 20 | 0.5 | 25 | 600 | 30 | M + F + γ | 30 | 15 |

| | Tensile Properties | | | Corrosion Test | | | |
|---|---|---|---|---|---|---|---|
| | | | | Weight loss | | SSC | |
| Pipe No. | Yield Strength (MPa) | Tensile Strength (MPa) | Toughness $vE_{-10}$ (J) | corrosion rate (mm/y) | Pitting Corrosion | resistance test Crack | Note |
| 1 | 919 | 1112 | 224 | 0.08 | Not Occurred | Not Occurred | Example |
| 2 | 878 | 1125 | 114 | 0.08 | Not Occurred | Occurred | Comparative Example |
| 3 | 759 | 1149 | 236 | 0.08 | Not Occurred | Occurred | Comparative Example |
| 4 | 661 | 994 | 183 | 0.08 | Not Occurred | Occurred | Comparative Example |
| 5 | 892 | 956 | 241 | 0.03 | Not Occurred | Not Occurred | Example |
| 6 | 935 | 1108 | 218 | 0.05 | Not Occurred | Not Occurred | Example |
| 7 | 924 | 1119 | 234 | 0.10 | Not Occurred | Not Occurred | Example |
| 8 | 915 | 1069 | 236 | 0.09 | Not Occurred | Not Occurred | Example |
| 9 | 905 | 1147 | 228 | 0.10 | Not Occurred | Not Occurred | Example |
| 10 | 954 | 1142 | 209 | 0.12 | Not Occurred | Not Occurred | Example |
| 11 | 919 | 1107 | 271 | 0.26 | Occurred | Occurred | Comparative Example |
| 12 | 803 | 945 | 244 | 0.07 | Not Occurred | Not Occurred | Example |
| 13 | 796 | 911 | 243 | 0.07 | Not Occurred | Not Occurred | Example |
| 14 | 844 | 927 | 238 | 0.03 | Not Occurred | Not Occurred | Example |
| 15 | 915 | 1143 | 218 | 0.05 | Not Occurred | Not Occurred | Example |
| 16 | 862 | 1018 | 242 | 0.09 | Not Occurred | Not Occurred | Example |

*Mean Cooling Rate from 800° C. to 500° C.
**M: Martensite. F: Ferrite, γ: Retained Austenite The examples are all seamless pipes having a yield strength of 758 MPa or more, a toughness of an absorbed energy $vE_{10}$ of 40 J or more at a temperature of −10° C., excellent corrosion resistance (resistance to carbon dioxide corrosion) in a corrosive environment of a high temperature in which $CO_2$ and $Cl^-$ are present and resistance to sulfide stress cracking so excellent that a crack does not occur in an environment in which $H_2S$ is present. On the other hand, the comparative examples out of our range had strength lower than was required, deteriorated corrosion resistance, or deteriorated resistance to sulfide stress cracking.

The invention claimed is:

1. A high strength stainless steel seamless pipe for an oil well, the pipe having a chemical composition containing, by mass %, C: 0.05% or less, Si: 0.5% or less, Mn: 0.15% or more and 1.0% or less, P: 0.030% or less, S: 0.005% or less, Cr: 13.5% or more and 15.4% or less, Ni: 3.5% or more and 6.0% or less, Mo: 1.5% or more and 5.0% or less, Cu: 3.5% or less, W: 2.5% or less, N: 0.15% or less, Sn: 0.05% or more and 0.20% or less, and the balance being Fe and inevitable impurities so that formula (1) is satisfied by C, Si, Mn, Cr, Ni, Mo, W, Cu, and N: formula (1) is $$-5.9\times(7.82+27C-0.91Si+0.21Mn-0.9Cr+Ni-1.1Mo-0.55W+0.2Cu+11N)\geq 13.0 \quad (1),$$

where C, Si, Mn, Cr, Ni, Mo, W, Cu, and N respectively denote the contents (mass %) of corresponding chemical elements.

2. The high strength stainless steel seamless pipe according to claim 1, wherein the pipe has a chemical composition further containing, by mass %, V: 0.02% or more and 0.12% or less.

3. The high strength stainless steel seamless pipe according to claim 1, wherein the pipe has a chemical composition further containing, by mass %, Al: 0.10% or less.

4. The high strength stainless steel seamless pipe according to claim 1, wherein the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

5. The high strength stainless steel seamless pipe according to claim 1, wherein the pipe has a chemical composition further containing, by mass %, one or more selected from among REM: 0.005% or less and Ca: 0.005% or less.

6. The high strength stainless steel seamless pipe according to claim 1, wherein the pipe further has a microstructure including a martensite as a base phase and 10% or more and 60% or less, in terms of volume fraction, of a ferrite phase as a second phase.

7. The high strength stainless steel seamless pipe according to claim 6, wherein the pipe has a microstructure further including, in terms of volume fraction, 30% or less of a retained austenite phase.

8. The high strength stainless steel seamless pipe according to claim 2, wherein the pipe has a chemical composition further containing, by mass %, Al: 0.10% or less.

9. The high strength stainless steel seamless pipe according to claim 2, wherein the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

10. The high strength stainless steel seamless pipe according to claim 3, wherein the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

11. The high strength stainless steel seamless pipe according to claim 2, wherein the pipe has a chemical composition further containing, by mass %, one or more selected from among REM: 0.005% or less and Ca: 0.005% or less.

12. The high strength stainless steel seamless pipe according to claim 3, wherein the pipe has a chemical composition further containing, by mass %, one or more selected from among REM: 0.005% or less and Ca: 0.005% or less.

13. The high strength stainless steel seamless pipe according to claim 4, wherein the pipe has a chemical composition further containing, by mass %, one or more selected from among REM: 0.005% or less and Ca: 0.005% or less.

14. A method of manufacturing a high strength stainless steel seamless pipe comprising performing a quenching treatment and a tempering treatment on a stainless steel seamless pipe having a chemical composition containing, by mass %, C: 0.05% or less, Si: 0.5% or less, Mn: 0.15% or more and 1.0% or less, P: 0.030% or less, S: 0.005% or less, Cr: 13.5% or more and 15.4% or less, Ni: 3.5% or more and 6.0% or less, Mo: 1.5% or more and 5.0% or less, Cu: 3.5% or less, W: 2.5% or less, N: 0.15% or less, Sn: 0.05% or more and 0.20% or less, and the balance being Fe and inevitable impurities so that formula (1) is satisfied by C, Si, Mn, Cr, Ni, Mo, W, Cu, and N: formula (1) is $$-5.9\times(7.82+27C-0.91Si+0.21Mn-0.9Cr+Ni-1.1Mo-0.55W+0.2Cu+11N)\geq 13.0 \quad (1),$$

where C, Si, Mn, Cr, Ni, Mo, W, Cu, and N respectively denote the contents (mass %) of corresponding chemical elements, the quenching treatment including heating the pipe up to a temperature of 850° C. or higher and cooling the heated pipe at a cooling rate equal to or more than that of air cooling to a temperature of 50° C. or lower, the tempering treatment including heating the treated pipe up to a temperature equal to or lower than the $A_{c1}$ transformation point and cooling the heated pipe.

15. The method according to claim 14, wherein the pipe has a chemical composition further containing, by mass %, V: 0.02% or more and 0.12% or less.

16. The method according to claim 14, wherein the pipe has a chemical composition further containing, by mass %, Al: 0.10% or less.

17. The method according to claim 14, wherein the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

18. The method according to claim 14, wherein the pipe has a chemical composition further containing, by mass %, one or more selected from among REM: 0.005% or less and Ca: 0.005% or less.

19. The method according to claim 15, wherein the pipe has a chemical composition further containing, by mass %, Al: 0.10% or less.

20. The method according to claim 15, wherein the pipe has a chemical composition further containing, by mass %, one or more selected from among Nb: 0.02% or more and 0.50% or less, Ti: 0.02% or more and 0.16% or less, Zr: 0.50% or less, and B: 0.0030% or less.

* * * * *